US008511681B2

(12) United States Patent
Nakata et al.

(10) Patent No.: US 8,511,681 B2
(45) Date of Patent: Aug. 20, 2013

(54) PAPER SHEETS HANDLING APPARATUS

(75) Inventors: Yasuhiro Nakata, Owariasahi (JP); Masanori Terao, Nagoya (JP); Sho Mizuno, Nagoya (JP); Hirokazu Aoji, Owariasahi (JP); Hiroshi Mizutani, Owariasahi (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 33 days.

(21) Appl. No.: 13/083,027

(22) Filed: Apr. 8, 2011

(65) Prior Publication Data

US 2011/0266741 A1 Nov. 3, 2011

(30) Foreign Application Priority Data

Apr. 30, 2010 (JP) ..... 2010-105273

(51) Int. Cl.
*B65H 39/10* (2006.01)

(52) U.S. Cl.
USPC ..... 271/305; 271/306; 271/303

(58) Field of Classification Search
USPC ..... 271/302, 303, 305, 306
See application file for complete search history.

(56) References Cited

U.S. PATENT DOCUMENTS

| | | | | |
|---|---|---|---|---|
| 5,131,644 | A * | 7/1992 | DuBois | 271/84 |
| 5,222,730 | A * | 6/1993 | Miyake | 271/296 |
| 6,695,307 | B2 * | 2/2004 | Kanagawa | 271/207 |
| 7,900,916 | B2 * | 3/2011 | Sugahara et al. | 271/264 |
| 8,087,656 | B2 * | 1/2012 | Fujita et al. | 271/3.01 |
| 2002/0074709 | A1 | 6/2002 | Kanagawa | |

FOREIGN PATENT DOCUMENTS

| | | | |
|---|---|---|---|
| EP | 1 209 633 | A2 | 5/2002 |
| EP | 2 096 062 | A2 | 9/2009 |
| EP | 2 151 805 | A1 | 2/2010 |
| JP | 07-244771 | | 9/1995 |
| JP | 11-213209 | | 8/1999 |
| JP | 11-328495 | | 11/1999 |
| JP | 2002-163704 | A | 6/2002 |
| JP | 2005-259084 | | 9/2005 |

OTHER PUBLICATIONS

European Patent Office extended search report on application No. 11161913.6 dated Sep. 2, 2011; 6 pages.
Japanese Patent Office action on application 2010-105273 dated Jun. 19, 2012; pp. 1-2.

* cited by examiner

*Primary Examiner* — Stefanos Karmis
*Assistant Examiner* — Ernesto Suarez
(74) *Attorney, Agent, or Firm* — Foley & Lardner LLP

(57) ABSTRACT

A paper money handling apparatus comprises a service mechanism unit for delivery of a paper sheet or sheets, a counting processing unit for counting of a paper sheet or sheets, a stacker for storing of a paper sheet or sheets, and conveyance paths for conveyance of a paper sheet or sheets to the service mechanism unit, the counting processing unit, and the stacker. The apparatus further comprises connection guides provided between the conveyance paths and the stackers to perform delivery of a paper sheet or sheets, a motor, a cam and a solenoid, which switch the connection guides to a connected state to connect the same to the conveyance paths and the stackers to enable delivery of a paper sheet or sheets and to an evacuated state to release the connection.

9 Claims, 9 Drawing Sheets

PAPER SHEETS HANDLING APPARATUS

INCORPORATION BY REFERENCE

The present application claims priority from Japanese application JP2010-105273 filed on Apr. 30, 2010, the content of which is hereby incorporated by reference into this application.

BACKGROUND OF THE INVENTION

The invention relates to a paper sheets handling apparatus, in which, for example, a paper sheet or sheets are handled, and more particular, to a paper sheets handling apparatus used for window service in financial institutions.

Conventionally, cash automatic transaction apparatuses, such as ATM, CD, etc. in which paper money is subjected to receipt/payment transactions, are installed in financial institutions and shops such as convenience stores, etc. Paper money handling apparatuses mounted in cash automatic transaction apparatuses used in, for example, financial institutions, etc. comprise a paper money receipt/payment opening, through which paper money as paid is discharged to a user or paper money as charged is fed out sheet by sheet, a paper money discrimination unit for discrimination of paper money as received or paid, a temporary accumulation section for temporarily receiving paper money as received, stackers for receiving and storing paper money as received and paying it as paid paper money or the like, and a paper money conveyance path for connection of the respective sections.

Recently, paper money is increased in kind and an increase in capacity is achieved in paper money handling apparatuses constructed in a manner described above, so that it is general to align and arrange a plurality of stackers in a stacker storage section in a lower part of the apparatus and to collect and arrange a service mechanism section and a counting processing unit, which has the function of counting and discriminating paper money, in an upper part of the apparatus.

For paper money handling apparatuses having such configuration, the work of mounting and dismounting stackers, in which paper money is received, from the apparatus is frequently performed for the sake of maintenance and recharging of paper money. It is desired in paper money handling apparatuses constructed in a manner described above to enable drawing out only a stacker storage section to readily mount and dismount stackers.

Here, in order to perform delivery of paper sheets, such as paper money, or the like, between a counting processing unit and stackers without having them buckling or jamming, it is necessary to provide a conveyance guide on a paper sheet conveyance path. In particular, in the case where paper sheets come and go along a conveyance path, it is required that a conveyance guide on a side of the counting processing unit and a conveyance guide on a side of the stacker, which conveyance guides provide for a paper sheet delivery section, be shaped like the teeth of a comb and mounted in a position, in which the mutual conveyance guides nest.

In the apparatus having such configuration, the conveyance guide on the counting processing unit and the conveyance guide on the stacker enter into the constructions of the mates, so that the counting processing unit and the stacker cannot get out of phase.

Hereupon, there has been proposed a mechanism, in which a conveyance path section is mounted above stackers, delivery ports of the stackers for a counting processing unit are made intensive on one conveyance path section above the stackers, and mutual conveyance guides retreat in a delivery section between the upper conveyance path section and the counting processing unit (see JP-A-2005-259084).

With such mechanism, however, the upper conveyance path section above the stackers is drawn out simultaneously when a tray is drawn out. Therefore, in order to mount and dismount the stackers from an associated apparatus, an operation of further retreating the upper conveyance path section from above the stackers is needed, which causes a problem of bad operation or the like.

The invention has been thought of in view of the problem described above and has its object to provide a paper sheets handling apparatus, in which a stacker or stackers can be readily mounted and dismounted, thus achieving an improvement in convenience.

SUMMARY OF INVENTION

The invention has a feature in a paper sheets handling apparatus comprising a service mechanism unit for delivery of a paper sheet or sheets, a counting processing unit for counting of the paper sheet or sheets, a stacker for storing of the paper sheet or sheets and a conveyance path for conveyance of the paper sheet or sheets to the service mechanism unit, the counting processing unit and the stacker, in that a delivery connection provided between the conveyance path and the stacker to perform delivery of a paper sheet or sheets, and connection switching means, which switches the delivery connection to a connected state to connect the same to the conveyance path and the stacker to enable delivery of a paper sheet or sheets and to an evacuated state to release the connection.

According to the invention, a paper sheets handling apparatus, in which a stacker or stackers can be readily mounted and dismounted is provided, thus enabling achieving an improvement in convenience.

Other objects, features and advantages of the invention will become apparent from the following description of the embodiments of the invention taken in conjunction with the accompanying drawings.

DESCRIPTION OF EMBODIMENTS

An embodiment of the invention will be described hereinafter with reference to the drawings.

Figure 1:
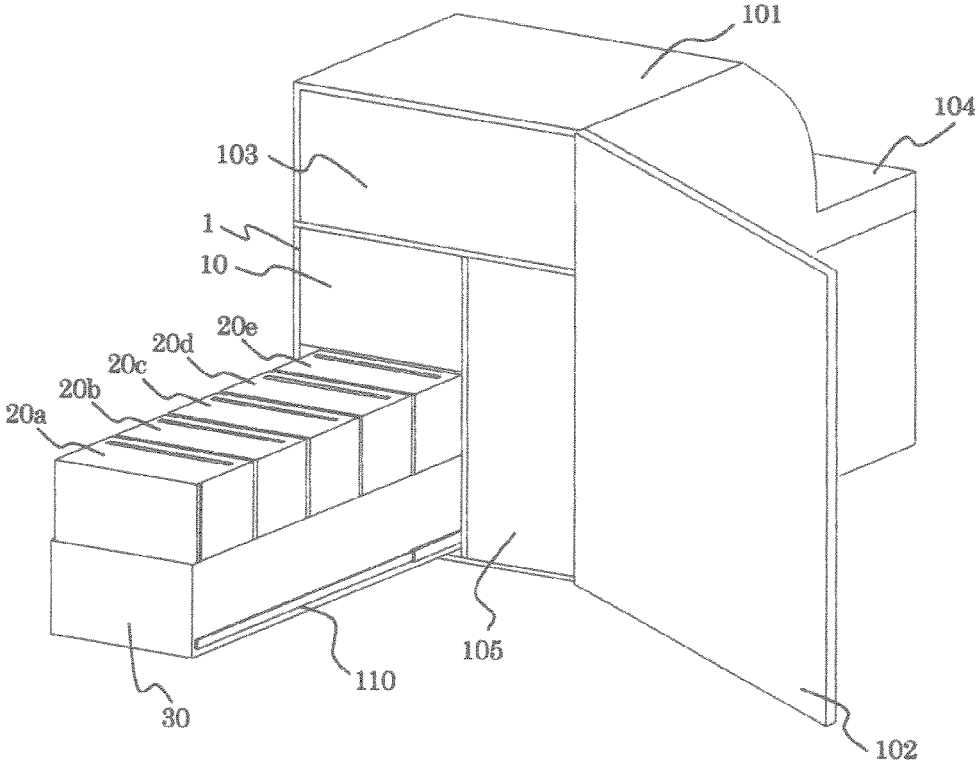
FIG. 1 is a perspective view showing an appearance of a cash automatic transaction apparatus on which a paper money handling apparatus is mounted.

FIG. 1 is a perspective view showing an appearance of a cash automatic transaction apparatus 101 on which a paper money handling apparatus 1 serving as a paper sheets handling apparatus. The cash automatic transaction apparatus 101 performs such processings as deposit, payment, and transfer by a user with a card, paper money, and a detailed slip as a medium.

A card and detailed slip processing mechanism 103 for processing a card of a user, printing and discharging a transaction detailed slip is provided in an upper part of the cash automatic transaction apparatus 101 and a customer operating unit 104 for displaying and inputting information of transaction is provided on the front of the apparatus. A paper money handling apparatus 1 for handling paper money, to which apparatus the invention is applied, is provided on the left of a lower part of the cash automatic transaction apparatus 101 in FIG. 1. A coin handling apparatus 105 is provided on the right of the paper money handling apparatus 1 in the lower part of the cash automatic transaction apparatus. The coin handling apparatus 105 may be dispensed with. Also, a door 102 is provided on the back of the cash automatic transaction apparatus.

By opening the door 102, a tray 30 of the paper money handling apparatus 1 can be drawn out by means of rails 110 serving as a drawer mechanism provided on the tray 30 and the paper money handling apparatus 1 or the cash automatic transaction apparatus 101. In a state, in which the tray 30 is drawn out, a stacker or stackers 20 can be mounted on and dismounted from the tray 30.

The cash automatic transaction apparatus 101 additionally comprises an electric power unit (depiction is omitted) for supplying of electric power to respective constituent parts and a body control unit (depiction is omitted), to which respective mechanisms are connected by means of circuits such as USB or the like.

Figure 2:
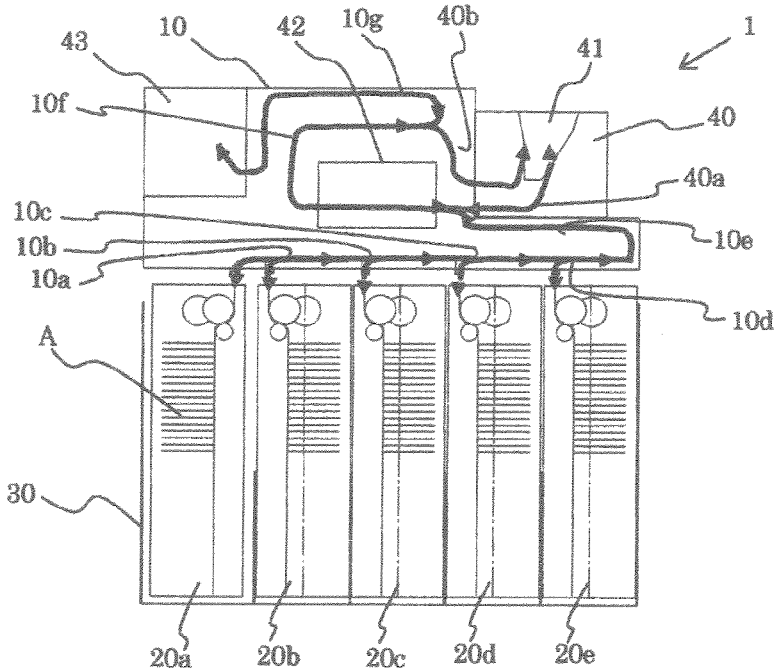
FIG. 2 is a view illustrating the construction of the paper money handling apparatus as viewed laterally.

FIG. 2 is a view illustrating the construction of the paper money handling apparatus 1 as viewed laterally. A counting processing unit 10 in an upper part of the paper money handling apparatus 1 comprises a service mechanism unit 40 having a paper money inlet/outlet port 41, at which delivery of paper money to and from a customer or an operator is performed, a discrimination unit 42 for counting and discrimination of paper money, and a temporary accumulation section 43 for temporarily storing after counting and discrimination are performed.

A plurality of stackers 20 for reception of paper money every kind and discharge of paper money as paid are provided in a lower part of the paper money handling apparatus 1 and mounted on the tray 30.

These mechanism units, respectively, are connected by means of conveyance paths 10*a* to 10*g*, 40*a*, and 40*b* for delivery and receipt of paper money.

The counting processing unit 10 and the tray 30, respectively, are mounted independently to the cash automatic transaction apparatus 101 (see FIG. 1) with the rails 110 therebetween.

The rails 110 used for drawing out the tray 30 are mounted to the counting processing unit 10. The tray 30 is mounted to the cash automatic transaction apparatus 101 with the counting processing unit 10 therebetween.

In addition, any one of stackers 20*a* to 20*e* may be replaced by a reject box, in which paper money not submitted to payment is received.

At the time of receiving transaction, paper money charged into the inlet/outlet port 41 is separated and sent out sheet by sheet in the service mechanism unit 40 and counted and discriminated by the discrimination unit 42 when passing along the conveyance path 10*f* through the conveyance path 40*a*. Then, paper money passes along the conveyance path 10*g* to be stored in the temporary accumulation section 43. After all the paper money as charged are stored in the temporary accumulation section 43 and transaction amount is confirmed, the paper money is separated and fed out sheet by sheet by the temporary accumulation section 43. The paper money goes by way of the conveyance path 10*g* and the conveyance path 10*f* and is again counted and discriminated by the discrimination unit 42 to reach the conveyance path 10*e*. Further, the paper money goes by way of the conveyance paths 10*a*, 10*b*, 10*c*, and 10*d* to be stored in the stackers 20 (20*a* to 20*e*) instructed by the apparatus, and the receiving transaction is terminated.

At the time of payment transaction, paper money is separated and fed out sheet by sheet from the stackers 20 (20*a* to 20*e*) designated by the paper money handling apparatus 1. The paper money goes by way of the conveyance path 10*e* to pass along the conveyance path 10*f* and is discriminated and counted by the discrimination unit 42. The paper money goes by way of the conveyance path 40*b* to reach the inlet/outlet port 41 of the service mechanism unit 40 to be presented to a customer. Thereby, the payment transaction is terminated.

Figure 3:
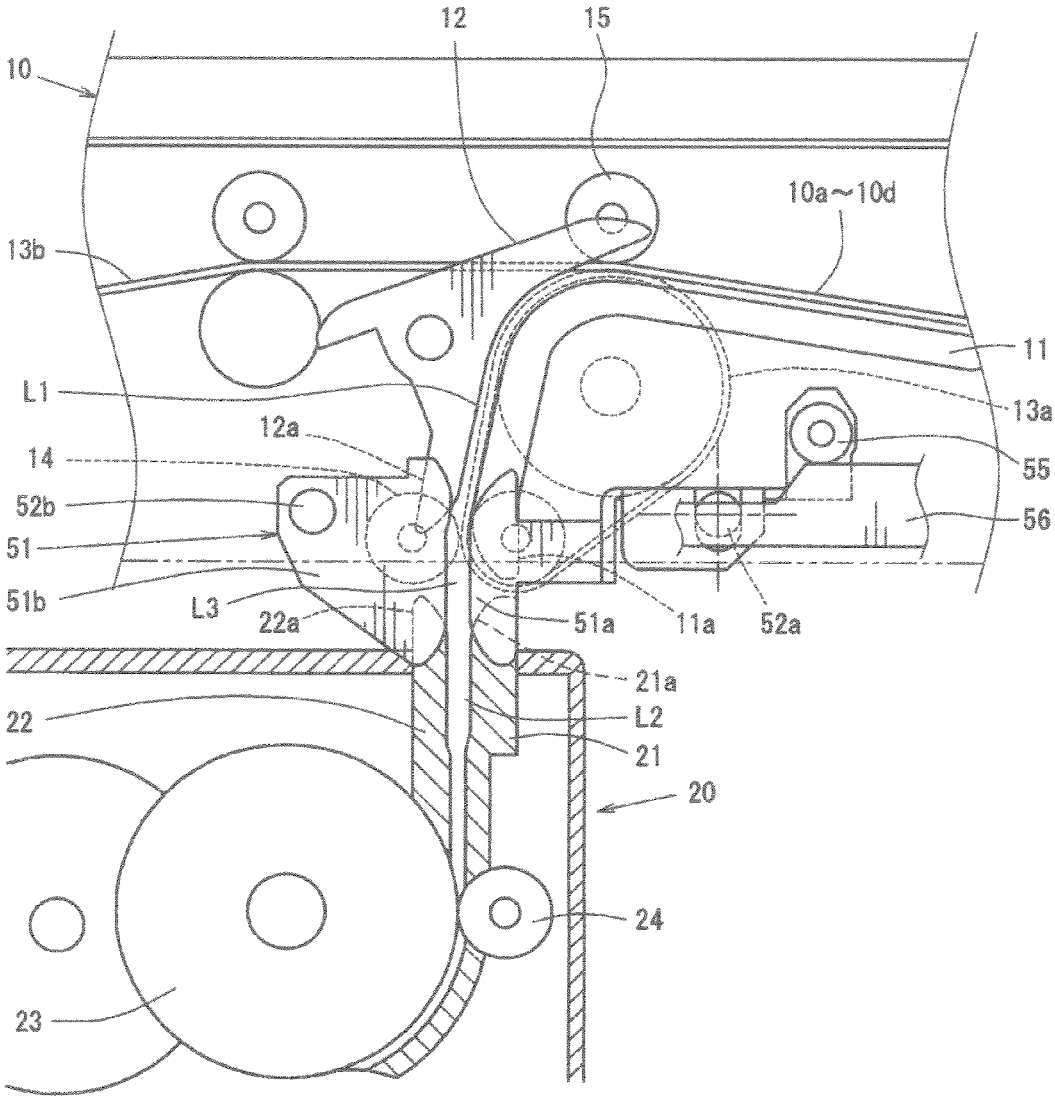
FIG. 3 is a lateral, cross sectional view showing, in partially enlarged scale, the construction of a periphery of a connection guide in a connected state.
Figure 4:
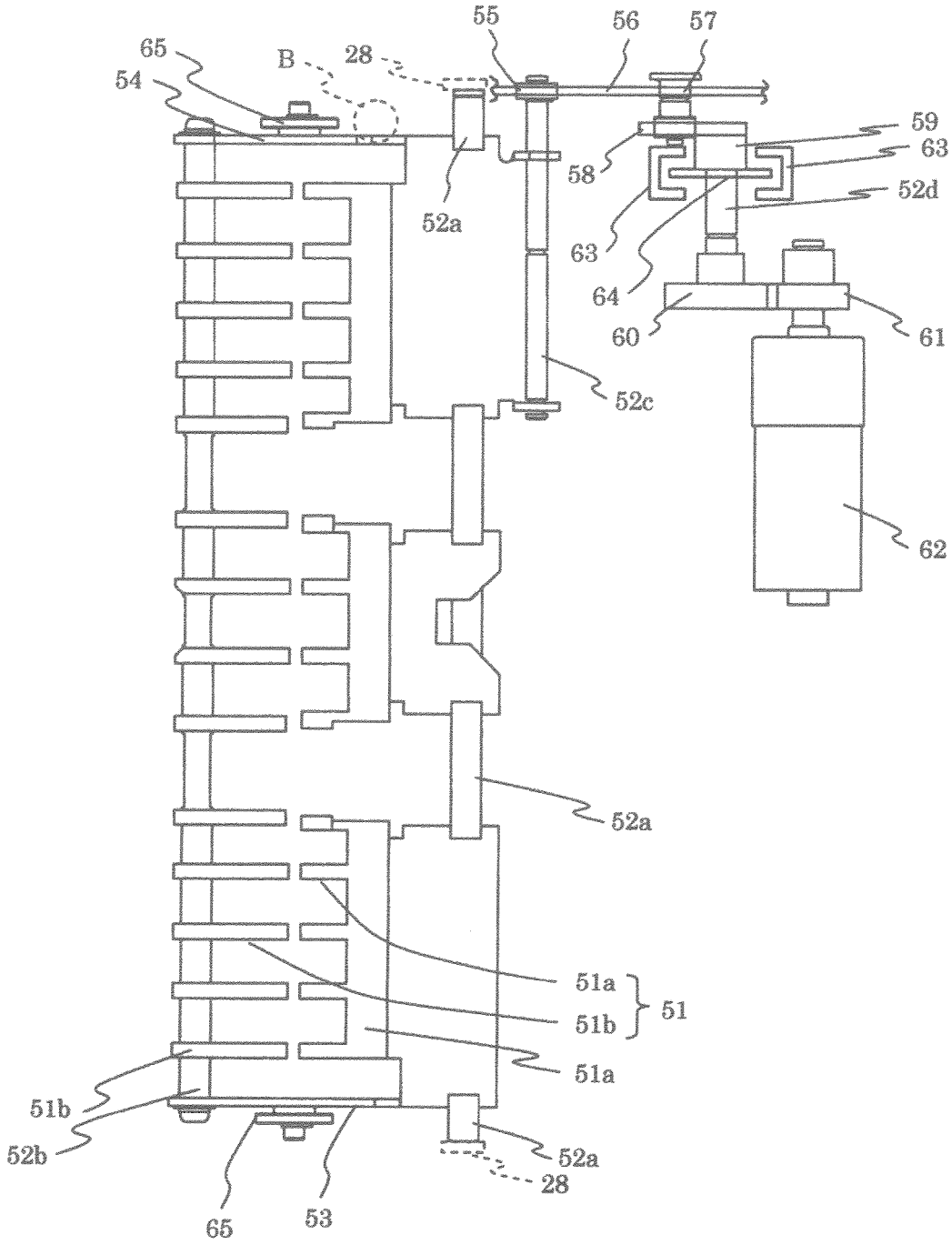
FIG. 4 is a plan view showing the periphery of the connection guide as viewed from a conveyance plane.
Figure 5:
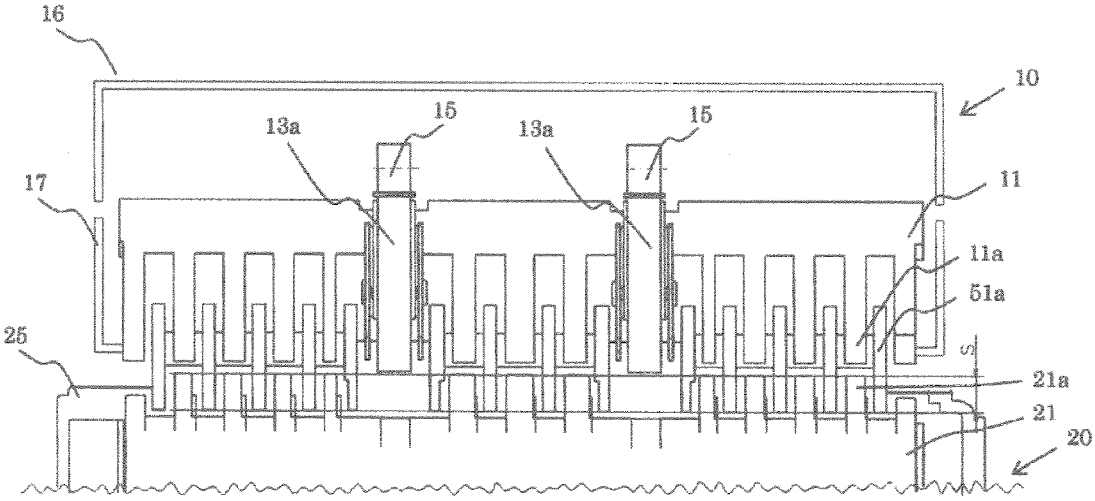
FIG. 5 is a rear view showing, in enlarged scale, the periphery of the connection guide in the connected state.
Figure 6:
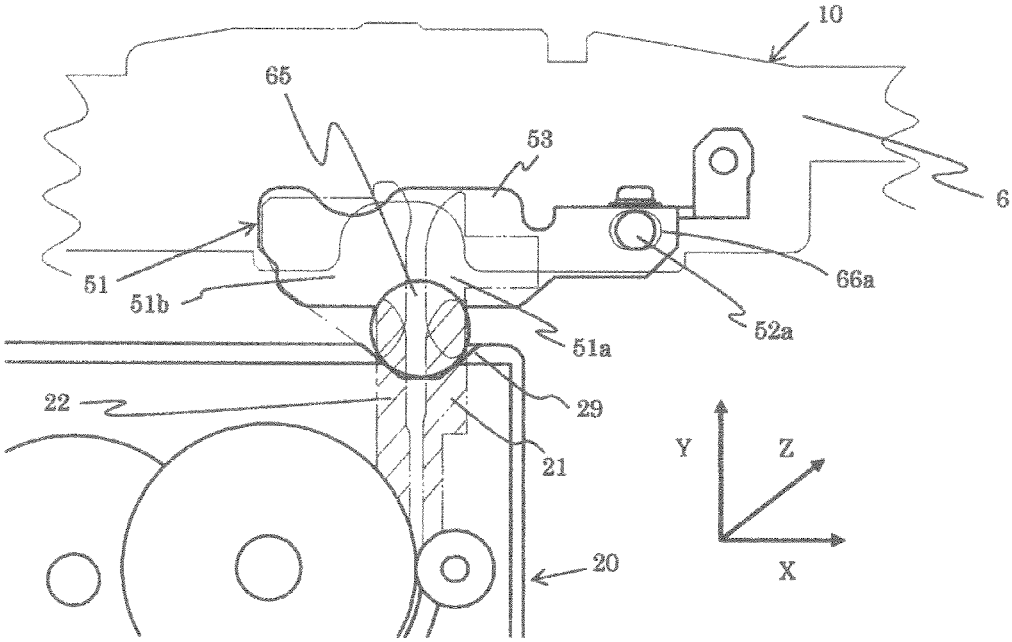
FIG. 6 is a lateral, cross sectional view showing, in partially enlarged scale, the periphery of a positioning roller in the connected state.

FIG. 3 is a lateral, cross sectional view showing, in partially enlarged scale, the construction (connected state) of a connection guide 51 (51*a*, 51*b*) serving as a delivery connecting section for connection between the counting processing unit 10 and a conveyance path of the stacker 20, FIG. 4 is a plan view showing the periphery of the connection guide 51 as viewed from a conveyance plane, FIG. 5 is a rear view showing, in enlarged scale, the periphery of the connection guide 51*a* provided on the counting processing unit 10, and FIG. 6 is a lateral, cross sectional view showing, in partially enlarged scale, the periphery of the connection guide 51 as viewed in another vertical plane.

As shown in FIG. 3, a length of belt 13*b* is stretched in a front and rear direction on the counting processing unit 10. The belt 13*b* is positioned above the stackers 20*a* to 20*e* arranged in plural in the front and rear direction (a left and right direction as shown) to constitute the conveyance paths 10*a* to 10*d* for two-way conveyance of paper money in the front and rear direction.

The conveyance paths 10*a* to 10*d* constituted by the belt 13*b* comprise a stacker leading guide 11 and a director flapper 12, which are assigned to each of the stackers 20*a* to 20*e*. A roller 15 acting on the belt 13*b* is provided to be positioned in conformity to the director flapper 12.

The stacker leading guide 11 is curved in the front and rear direction to distribute and lead paper money obliquely downward and the director flapper 12 distributes paper money to lead paper money to the stacker 20 along the stacker leading guide 11 or to convey paper money as it is by way of the belt 13*b*. The director flapper 12 together with the stacker leading guide 11 constitutes a leading conveyance path L1, along which paper money is led and conveyed obliquely downward (paper sheet delivery direction), in a director position to the stacker 20 shown in FIG. 3.

Also, a length of belt 13*a* is provided along the stacker leading guide 11 and a pinch roller 14 is provided in opposition to the belt 13*a* in the vicinity of a lower end of the leading conveyance path L1 which corresponds to a lower end position of the belt 13*a*. The pinch roller 14 and the belt 13*a* interpose therebetween paper money in the vicinity of the lower end of the leading conveyance path L1 to have the paper money fed to the stacker 20 and taken out from the stacker 20.

A comb-teeth shaped projection 11*a* is provided at a lower end of the stacker leading guide 11 and a comb-teeth shaped projection 12*a* is provided at a lower end of the director flapper 12. The comb-teeth shaped projections 11*a*, 12*a* function as stacker-side conveyance connections for delivery of paper money between them and the stacker 20.

Provided in an upper part of the stacker 20 are a stacker-side delivery guide 21 and a stacker-side delivery guide 22, which constitute a leading conveyance path L2 in a vertical direction. The stacker-side delivery guide 21 and the stacker-side delivery guide 22 are arranged in opposition to each other so as to interpose paper money therebetween to convey the same in the vertical direction and, respectively, provided at upper ends thereof with comb-teeth shaped projections 21*a*, 22*a*. The comb-teeth shaped projections 21*a*, 22*a* function as conveyance path side conveyance connections for delivery of paper money between them and the counting processing unit 10.

Lower portions of the stacker-side delivery guide 21 and the stacker-side delivery guide 22 are coupled to a feed roller 23 and a pinch roller 24, which are arranged in opposition to each other, and paper money as conveyed is interposed by the feed roller 23 and the pinch roller 24 to be accumulated in the stacker 20.

The comb-teeth shaped projections 11*a*, 12*a* and the comb-teeth shaped projections 21*a*, 22*a*, which serve as connections of the leading conveyance path L1 and the leading conveyance path L2, are provided on opposed portions thereof with the connection guide 51, and the connection guide 51 provides for conveyance and connection between the counting processing unit 10 and the stacker 20.

The connection guide 51 comprises the connection guide 51*a* and the connection guide 51*b*, which are arranged in opposition to each other. Both the connection guide 51*a* and the connection guide 51*b* are provided at both upper and lower ends thereof with comb-teeth shaped projections.

As shown in FIG. 5, the comb-teeth shaped projection at the upper end of the connection guide 51*a* is mounted so as to enter an interior of the counting processing unit 10 and constructed to nest in the comb-teeth shaped projection 11*a* of the stacker leading guide 11.

As shown in FIG. 5, the comb-teeth shaped projection at the lower end of the connection guide 51*a* is mounted to enter an interior of the stacker 20 and constructed to nest in the comb-teeth shaped projection 21*a* of the stacker leading guide 21.

Likewise, the comb-teeth shaped projection at the upper end of the connection guide 51*b* is mounted to enter the interior of the counting processing unit 10 and constructed to nest in the comb-teeth shaped projection 12*a* of the director flapper 12. The comb-teeth shaped projection at the lower end of the connection guide 51*b* is mounted to enter the interior of the stacker 20 and constructed to nest in the comb-teeth shaped projection 22*a* of the stacker leading guide 22.

A nesting depth S in a state, in which comb teeth of the connection guide 51*a* and the opposite connection guide 51*b* of the counting processing unit 10 and the stacker leading guide 21 and the opposite stacker leading guide 22 of the stacker 20 are connected together, is set to be at least 9 mm. The reason for this is that since paper sheets, such as paper money, etc. are conveyed two-way, a rake-shaped groove (a groove in a position, in which respective comb teeth overlap in those portions thereof, which are curved from straight portions, as shown in FIG. 3) formed by comb-teeth portions of the connection guide 51*a* of the counting processing unit and the connection guide 21*a* of the stacker is removed as far as possible whereby the connection guide 51*a* and the opposite connection guide 51*b* of the counting processing unit is prevented from catching paper sheets, such as paper money, etc.

As shown in FIG. 4, the connection guide 51*a* and the connection guide 51*b* are constructed in an integral manner by plates 53, 54 disposed at both ends thereof to function as the single connection guide 51. A shaft 52*a* as a rotating shaft extending in a horizontal direction, which is a direction being widthwise of conveyance of paper money, is provided forwardly ion the right as shown) of the connection guide 51. A bearing 55 for restriction of vertical movements of the connection guide 51 is provided further forwardly of the shaft 52*a*.

An outer periphery of the bearing 55 abuts against an upper edge of the plate 54. Also the plate 54 is pulled upward by a spring B shown in FIG. 4. Therefore, the connection guide 51 is always biased by an upwardly directed force.

Accordingly, the rotating range of the connection guide 51 biased upward in the rear of the shaft 52*a* to act rotatingly is restricted until the bearing 55 disposed forwardly of the shaft 52*a* strikes against the upper edge of the plate 54. That is, when the height of the upper edge of the plate 54, against which the bearing 55 abuts, is varied, the connection guide 51 acts rotatingly according to the variation in height.

Thereby, as shown in FIG. 3, the connection guide 51 is driven to an evacuated state evacuation in which the connection guide 51 is turned to an inclined state of being positioned above the shaft 52*a*, from a connection state (coupling), in which the connection guide 51 is positioned substantially horizontal relative to the shaft 52*a*.

As shown in FIG. 4, the bearing 55 provided on the plate 54 is provided on a shaft 52*c*, and to the bearing 55, a link plate 56 (first engagement) is further connected. The link plate 56 is pulled forward (on the right in FIG. 4) by a spring (depiction is omitted). The link plate 56 is provided with a pin 57, on which a bearing 58 is provided.

The bearing 58 is connected to a cam 59 and further to a shading plate 64. The shading plate 64 rotates in a sensor 63 to have rotation thereof detected by the sensor 63.

The shading plate is provided at a tip end thereof with a gear 60. The gear 60 and the cam 59 rotate synchronously about a shaft 52*d*. A motor 62 gives a rotating drive to a gear 61.

Positioning rollers 65, respectively, are provided outwardly of the plates 53, 54. The positioning rollers 65 rotate about an axis in parallel to the shafts 52*a*, 52*c*, 52*d* to accurately position the stacker 20 and the connection guide 51 in the front and rear direction and in the vertical direction.

Stated in detail, as shown in FIG. 6, positioning recesses 29 (second engagement) are provided near both left and right ends on an upper surface of a housing of the stacker 20. The positioning recesses 29 are V-shaped as viewed laterally to be made flat at a bottom thereof and an outer periphery of the positioning roller 65 comes into contact with front and rear slant surfaces of the positioning recess to be supported at two points. In addition, such support may be replaced by 3-point support, in which the outer periphery of the positioning roller 65 comes into contact with front and rear slant surfaces and a bottom surface of the positioning recess 29. Thereby, the connection guide 51 having turned downward about the shaft 52*a* stops since the positioning roller 65 comes into contact with the positioning recess 29 of the stacker 20. Accordingly, the relative positions of the connection guide 51 and the stacker 20 are fixed. In particular, since the positioning recess 29 is provided in a position aligned in series widthwise of the direction of conveyance with the comb-teeth shaped projections 21*a*, 22*a* of the stacker-side delivery guides 21, 22, it is possible to accurately position those relative positions of the comb-teeth shaped projection at the lower end of the connection guide 51 and the comb-teeth shaped projections 21*a*, 22*a*, of which positional accuracy is most demanded for delivery.

In addition, the shaft 52*a* is extended through an elliptical hole 66*a*, which is provided in a frame 66 of the counting processing unit 10 to be long in the front and rear direction (a left and right direction as shown). Therefore, when the positioning roller 65 enters the positioning recess 29 to be positioned, the connection guide 51 supported on the shaft 52 moves backward and forward as a whole when needed, so that the positioning roller 65 is accurately received and positioned in the positioning recess 29.

Also, the shaft 52*a* is structured such that one shaft end thereof is in a state of directly and always contacting with a positioning plate 28 (see FIG. 4), which is provided on the counting processing unit 10 to serve as a positioning unit for the stacker 20. Thereby, there is provided a construction, in which the connection guide 51*a* and the opposite connection guide 51*b* provide for "play" relative to the stacker leading guide 21 and the opposite stacker leading guide 22 of the stacker 20 at the time of guide coupling. Thereby, the connection guide 51 is accurately positioned relative to the stacker 20 in a width direction (an up and down direction in FIG. 4).

The paper money handling apparatus 1 constructed in this manner acts in the following manner.

In a starting state capable of service, as illustrated with reference to FIGS. 3 to 6, a leading conveyance path L3 of the connection guide 51 is put in a state of connection between the leading conveyance path L1 and the leading conveyance path L2. Therefore, paper money is conveyed smoothly along the leading conveyance path L3 of the connection guide 51 between the leading conveyance path L1 and the leading conveyance path L2.

At the time of receiving transaction, as shown in FIG. 3, paper money is led to the stacker leading guide 11 and the director flapper 12 and conveyed to the stacker 20 by the belt 13*a* and the pinch roller 14. At this time, the connection guide 51 guides paper money being delivered to the stacker 20.

The paper money having entered the stacker 20 is conveyed by the feed roller and the pinch roller 24 in the stacker 20 to be accumulated and stored.

At the time of payment transaction, paper money separated and fed out sheet by sheet is led to the counting processing unit 10 by the stacker leading guide 21 and the opposite stacker leading guide 22. At this time, the connection guide 51 guides paper money being delivered to the counting processing unit 10. The paper money reaches the belt 13*a* and the pinch roller 14 of the counting processing unit 10 to be conveyed in the counting processing unit 10.

Figure 7:
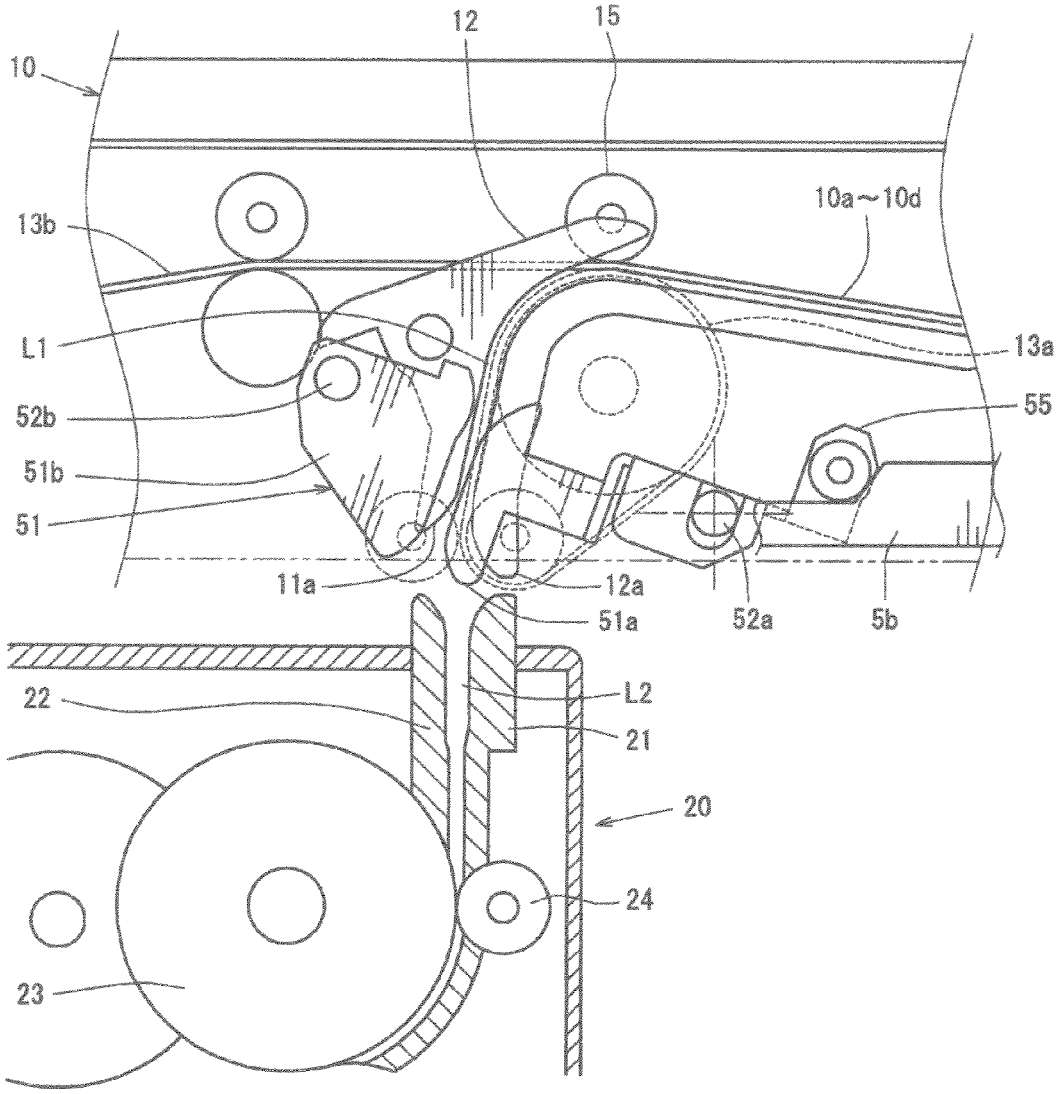
FIG. 7 is a lateral, cross sectional view showing, in partially enlarged scale, the periphery of the connection guide in an evacuated state.
Figure 8:
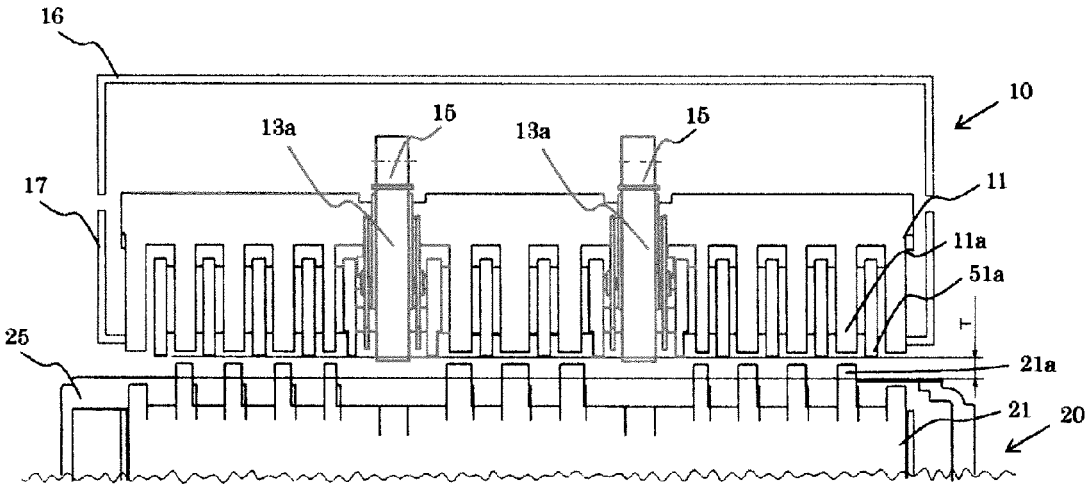
FIG. 8 is a rear view showing, in enlarged scale, the periphery of the connection guide in the connected state.
Figure 9:
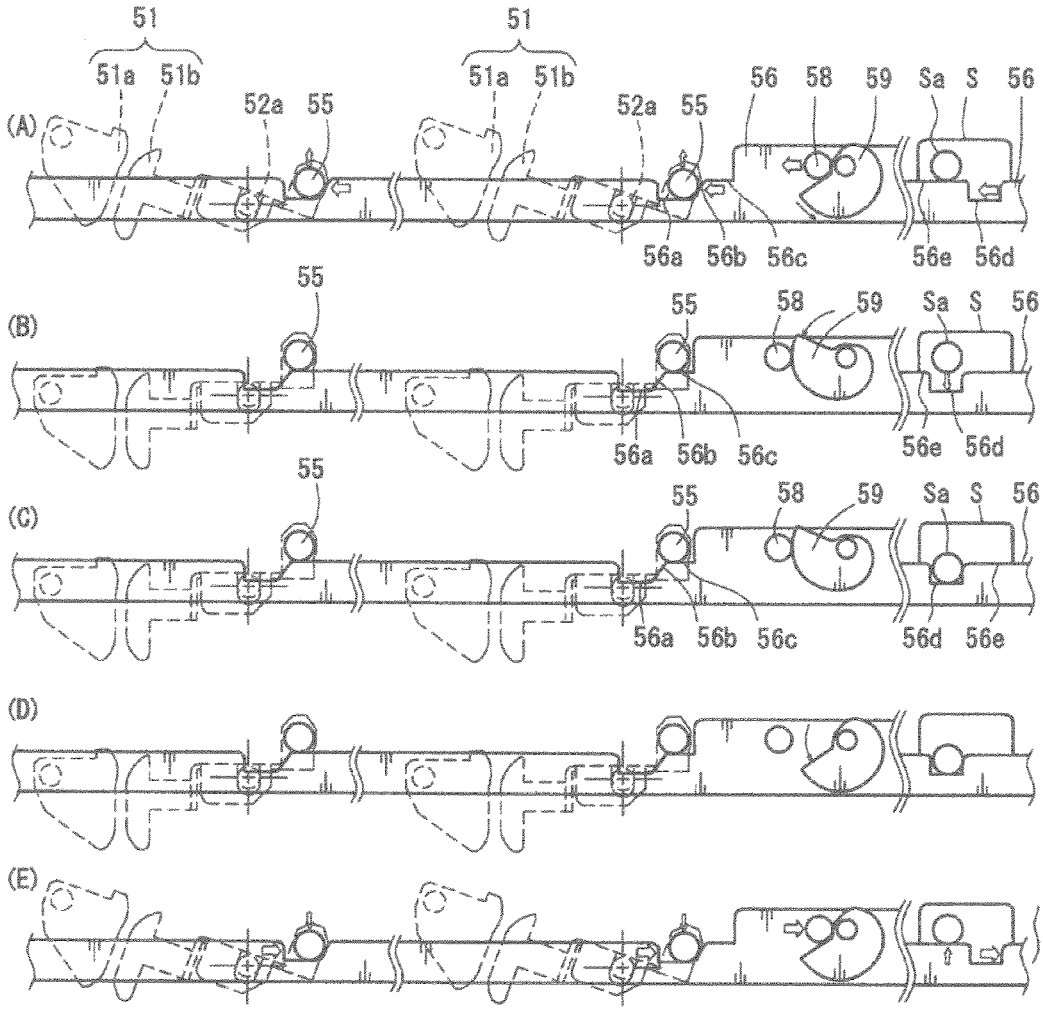
FIG. 9 is a view illustrating driving of the connection guide.
Figure 10:
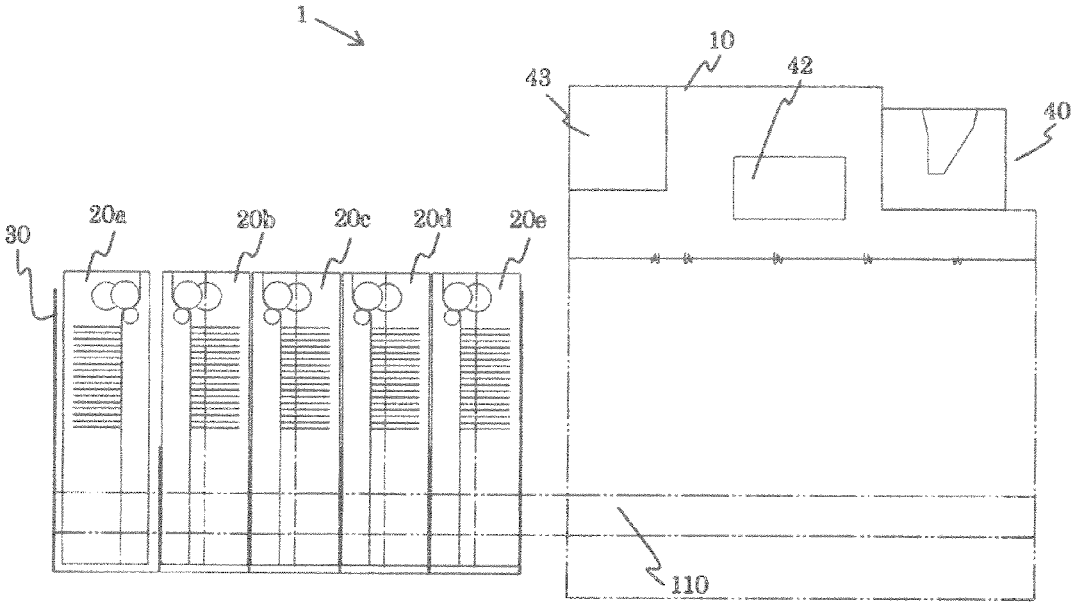
FIG. 10 shows the cash automatic transaction apparatus in a state in which a tray is drawn out from the rear thereof.
Figure 11:
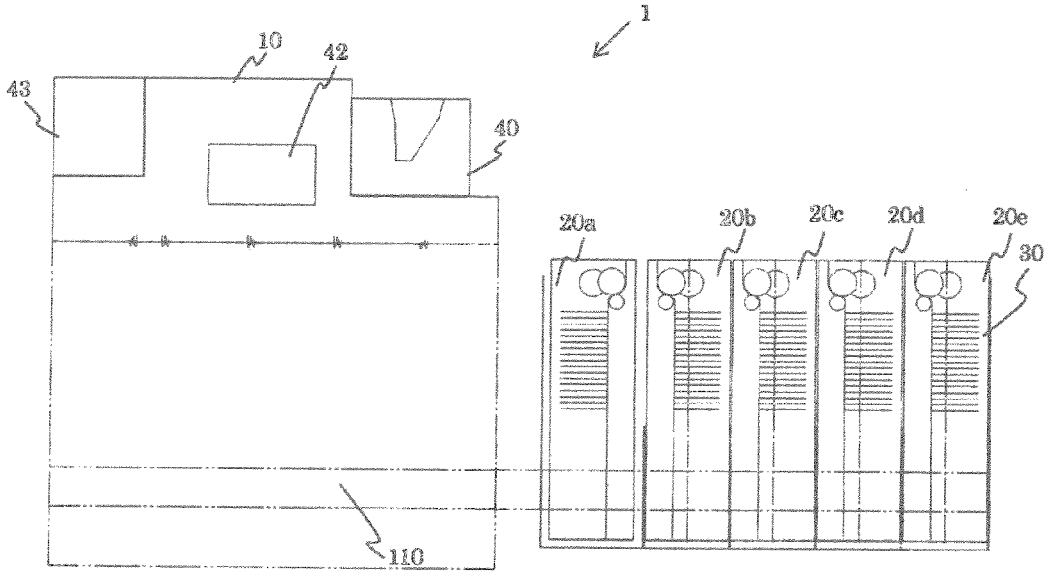
FIG. 11 shows the cash automatic transaction apparatus in a state, in which the tray is drawn out from the front thereof.

When electric power is not supplied, or before an operation (reset or the like) is started, the connection guide 51 is put in an evacuated state FIG. 7 is a lateral, cross sectional view showing, in partially enlarged scale, the configuration (evacuated state) of the connection guide 51 in the evacuated state, FIG. 8 is a rear view showing, in enlarged scale, the periphery of the connection guide 51*a* provided on the counting processing unit 10, FIG. 9 is a view illustrating driving of the connection guide 51 from the evacuated state to the connected state, and FIGS. 10 and 11 are side views showing a state, in which the tray 30 is drawn out of the paper money handling apparatus 1.

In the evacuated state, as shown in FIG. 7, the connection guide 51 of the counting processing unit 10 is in an evacuated position to be positioned upward. At this time, the comb-teeth shaped projection at the lower end of the connection guide 51 separates from the comb-teeth shaped projections 21*a*, 22*a* to be put in a completely separated state without a nesting construction. Even in the evacuated state, an upper end of the connecting conveyance path between the connection guides 51*a*, 51*b* is in communication to the leading conveyance path L1. That is, the connection guide 51 turning about the shaft 52*a* does not move just upward but moves upward and a little forward. Conforming to this, the leading conveyance path L1 is arranged obliquely so that an upper part thereof is positioned a little forward relative to a lower part thereof.

In this evacuated state, as shown in FIG. 8, the connection guide 51*a* and the connection guide 51*b* of the counting processing unit 10 is disposed above an upper surface of an outer casing 25 of the stacker 20 with a space T of at least 3 mm therebetween. This is necessary to form a space above the stacker leading guide 21 and the stacker leading guide 22 of the stacker 20 from the upper surface of the outer casing 25 of the stacker 20. Thereby, the tray 30 can be moved (drawn out) to a phase shown in FIG. 10 or FIG. 11. By moving the tray 30 to the phase shown in FIG. 10 or FIG. 11, it is possible to readily mount and dismount the stacker 20.

In this evacuated state, as shown in FIG. 9A, the bearing 55 is in contact with a bottom 56*a* of the evacuated recess provided on the link plate 56. The bearing 58 is in contact with that portion of the cam 59, which is the shortest in radius. Also, a pin Sa of a solenoid S does not enter a connected state maintaining recess 56*d* of the link plate 56 but abuts against an upper edge 56*e*.

When an operation (reset or the like) is started, coupling of the guides is performed. At this time, rotational driving of the motor 62 (see FIG. 4) begins first. In keeping with this, the gear 61 rotates and the cam 59 rotates in synchronism with the rotation of the gear 61.

Thereby, when the cam 59 is caused to rotate as shown by an arrow in FIG. 9A, the bearing 58 is pushed rearward (on the left as shown) as a radius from a center of the cam 59 increases, so that the link plate 56 moves slidingly rearward.

At this time, the bearing 55 gets on a slant surface 56*b* of the evacuated recess provided on the link plate 56 to be lifted onto an upper edge 56*c*. Thereby, the connection guide 51 moves arcuately downward (a direction toward a switching operation) about the shaft 52*a* to shift to a connected state as shown in FIG. 9B.

The solenoid S moves the pin Sa downward to have the pin Sa enter the connected state maintaining recess 56*d* to maintain the connected state as shown in FIG. 9C.

The cam 59 is rotated further from this state, that portion thereof, which is the largest in radius from the center thereof, separates from the bearing 58, and such rotation is continued until that portion of the cam, which is the shortest in radius, is positioned in opposition to the bearing 58 as shown in FIG. 9D. In this state, the pin Sa of the solenoid S has entered the connected state maintaining recess 56*d*, and therefore, the link plate 56 is fixed without moving.

In this state, the paper money handling apparatus 1 is put in a state, in which service and transaction processings are carried out usually. That is, it is possible to appropriately carry out transactions such as receiving and payment.

When instruction of drawing out the tray 30 is issued to the paper money handling apparatus 1 from an operator, an evacuation operation of the guides is carried out. This operation is performed instantly by the pin Sa being moved upward by the solenoid S.

That is, when the pin Sa is moved upward by the solenoid S, positional fixation by the pin Sa and the connected state maintaining recess 56*d* is released and the link plate 56 is moved slidingly forward (on the right shown) by a spring (depiction is omitted). As shown in FIG. 9E, the link plate 56 is moved slidingly to stop until the bearing 58 comes into contact with that portion of the cam 59, which is the shortest in radius. Since the connection guide 51 is pulled upward by the spring B (see FIG. 4) to move arcuately upward (a direction toward a switching operation), the bearing 55 enters the bottom 56*a* of the evacuated recess and the connection guide 51 is put in the evacuated state (a state, in which the stacker leading guide 21 and the opposite stacker leading guide 22 of the stacker 20 do not overlap each other), so that the operation stops.

In this manner, the motor 62, the cam 59, and the solenoid S function as connection switching means to carry out connection and evacuation of the connection guide 51 from the leading conveyance paths L1, L2

Figure 12:
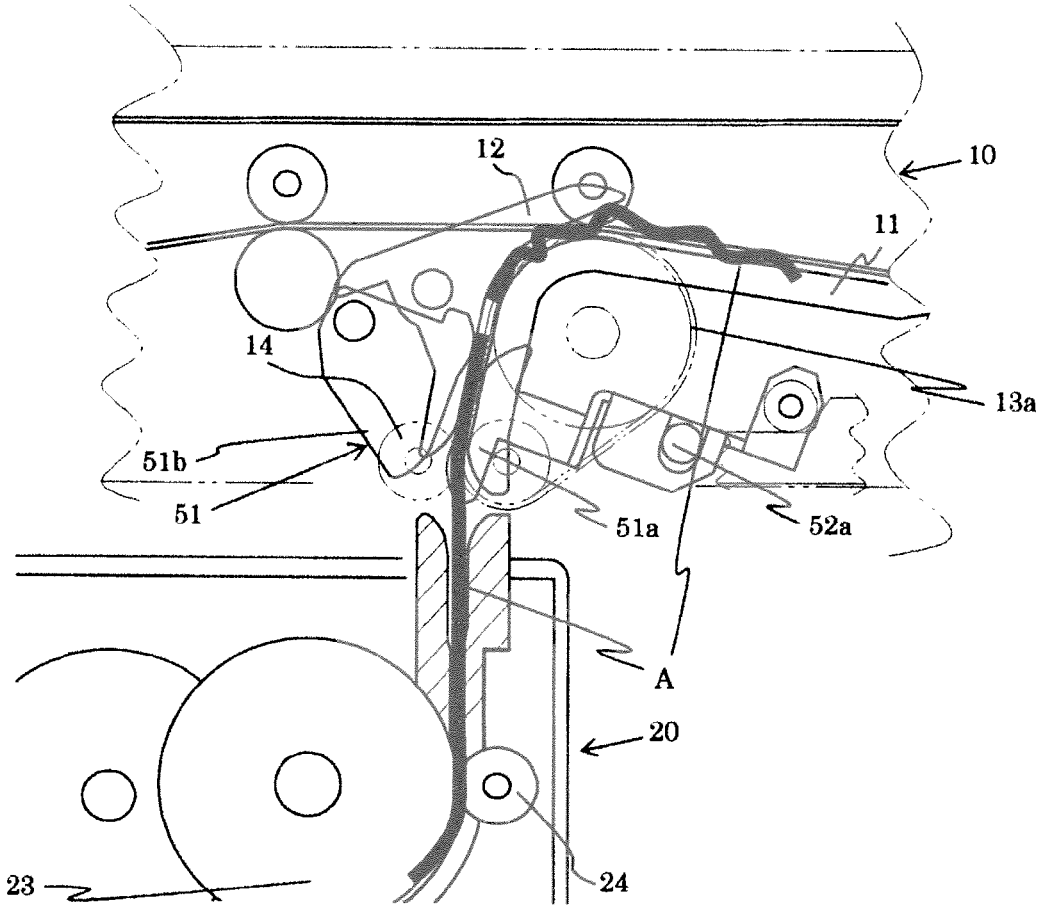
FIG. 12 is a lateral, cross sectional view showing, in partially enlarged scale, the periphery of the connection guide when jam occurs.

FIG. 12 is a lateral, cross sectional view showing in partially enlarged scale, the configuration of the connection guide 51 in a state, in which jam of paper money occurs.

Touch pressure M between the belt 13*a* and the pinch roller 14 in the counting processing unit 10 and touch pressure L between the feed roller 23 and the pinch roller 24 in the stacker 20 meet the relationship indicated in the following formula 1.

$$L>M$$

The connection guide 51*a* and the opposite connection guide 51*b* are set and formed in such a shape as not to fully fill a space (the leading conveyance path L1 in the counting processing unit) between the stacker leading guide 11 and the opposite director flapper 12 even when the guides are evacuated.

Therefore, as shown, in case of removing jam in the processing of jam and malfunction, jam can be readily removed even when a paper sheet A is present on the leading conveyance path L3 between the counting processing unit 10 and the stacker 20.

That is, in the case where both ends of the paper sheet A are interposed both between the belt 13*a* and the pinch roller 14 and between the feed roller 23 and the pinch roller 24, the paper sheet A is always held on the side of the stacker 20 owing to a difference between the touch pressure M and the touch pressure L as described above when the tray 30 is drawn out. Accordingly, it is possible to readily remove the paper sheet A from the stacker 20 in the tray 30 without tearing.

Owing to the above-described construction and operation, the connection guide 51 can be switched to the connected state and the evacuated state by the motor 62, the cam 59, and the solenoid S, so that it is possible to readily take out the stacker 20

In particular, since the stacker 20 together with the tray 30 can be separated from the conveyance paths 10*a* to 10*d* to be drawn out in a state, in which the conveyance paths 10*a* to 10*d* provided in the counting processing unit 10 are left on a body side of the paper money handling apparatus 1, any stacker 20 can be readily taken out when the tray 30 is drawn out. Accordingly, there is no need of that conventional operation, in which a tray 30 is drawn out and then an upper conveyance path is operatively opened, so that access to the stacker 20 can be made easy and short in a period of time.

Since the connection guide 51 is moved to the connected state and the evacuated state in a direction along the leading conveyance path L1, it is possible to shift the connection guide 51 to the evacuated state without any problem, even when jam of a paper sheet or sheets is generated. That is, if a state of conveyance path communication were gone from the connecting conveyance path L3 and the connecting conveyance path L1 when the connection guide 51 is shifted to the evacuated state from the connected state, the connection guide 51 could come into contact with a paper sheet or sheets in jam to generate a state of making evacuation impossible. In contrast, since the connection guide 51 is evacuated while a state of conveyance path communication is maintained, shift to the evacuated state can be completed without influences from paper money, which undergoes jam.

Thereby, when the processing of shifting the connection guide 51 to the evacuated state is performed and the tray 30 is drawn out, it is possible to prevent possible breakage of the comb-teeth shaped projections 21*a*, 22*a*, etc. resulted from incomplete evacuation of the connection guide 51 caused in fact by a paper sheet or sheets, which undergo jam.

Also, owing to that construction, in which the positioning rollers 65 provided on the connection guide 51 are caused to abut against the positioning recesses 29 provided on the stacker 20 to achieve positioning of the both, it is possible to accurately determine the relative, positional relationship of the counting processing unit 10 and the stacker 20 in a delivery region. In particular, even when switching is carried out any number of times in that construction, in which the connection guide 51 is switched between the connected state and the evacuated state upon drawing-out/storing of the tray 30, it is possible to accurately determine the relative position of a region, of which accuracy is most demanded for delivery.

Also, owing to that construction, in which an end of the shaft 52*a* for rotational operation of the connection guide 51 abuts against the positioning plate 28 of the stacker 20, it is possible to improve the positional accuracy of the connection guide 51 and the stacker 20 in the direction of widthwise of conveyance. In particular, owing to that construction, in which the end of the shaft 52*a* is caused to abut, it is possible to restrict a moving load on the positioning plate 28 which is an object of such abutting. That is, as compared with a sliding operation or the like, the rotational operation of the shaft 52*a* in the site can restrict abrasion of the positioning plate 28, etc. due to a frictional force upon operation.

Also since it is the structure that the connecting conveyance path L3 permits two-way conveyance of a paper sheet or sheets, the structure can be adopted in the paper money handling apparatus 1, of which two-way conveyance is demanded.

Also, since the connection guide 51 is mounted to the side of the counting processing unit 10, it is possible to make use of an empty space for the purpose of making the stacker 20 high in volume and to realize miniaturization of the paper money handling apparatus 1.

Also, since the link plate 56 causes a plurality of the connection guides 51 to be driven at once to switch all the connection guides 51 between the connected state and the evacuated state, driving in the lump can be stably carried out with a simple construction.

Also, since the nesting depth S of the comb-teeth shaped projections of the connection guide 51 and the comb-teeth shaped projections 21*a*, 22*a* in the connected state is made at least 9 mm, delivery of a paper sheet or sheets between the connecting conveyance path L3 and the connecting conveyance path L2 can be smoothly carried out thus enabling prevention of jam occurrence.

Also, owing to that construction, in which the comb-teeth shaped projections of the connection guide 51 and the comb-teeth shaped projections 21*a*, 22*a* completely separate from each other in the evacuated state, the comb-teeth shaped projections of the connection guide 51 and the comb-teeth shaped projections 21*a*, 22*a* do not interfere with each other in the drawing-out operation and the storing operation of the tray 30. Accordingly, it is possible to prevent breakage resulted from collision between the comb-teeth shaped projections of the connection guide 51 and the comb-teeth shaped projections 21*a*, 22*a*.

In addition, while the above embodiment has been described referring to the two-way conveyance paths, one-way conveyance paths for one-way conveyance of a paper sheet or sheets may be adopted. Even in this case, the same action and effect as those described above can be produced.

Also the link plate 56 may comprise a lever (not shown) to enable moving the link plate 56. In this case, the connection guide 51*a* and the connection guide 51*b* can be shifted manually to the connected state from the evacuated state even when electric power is not supplied to the motor 62.

Also, that construction, in which the sensor 63 with the use of the shading plate 64, which rotates interlocking with the cam 59, detects and controls positions, in which connection and evacuation (the connected state and the evacuated state) of the connection guide 51, may be adopted. In this case, the same action and effect as those described above can be produced.

The invention is not limited onto to the construction of the embodiment described above but many embodiments can be obtained.

The invention is applicable to apparatuses, in which various paper sheets such as paper money, card, paper (printed paper), etc. are handled.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper sheet handling apparatus comprising:

a service mechanism unit for delivery of a paper sheet or sheets;

a counting processing unit for counting of the paper sheet or sheets;

a stacker for storing of the paper sheet or sheets;

a conveyance path for conveyance of the paper sheet or sheets to the service mechanism unit, the counting processing unit and the stacker;

a delivery connection provided between the conveyance path and the stacker to perform delivery of a paper sheet or sheets; and connection switching means, which is configured to switch the delivery connection to a connected state to connect the same to the conveyance path and the stacker to enable delivery of a paper sheet or sheets and to an evacuated state to release the connection, wherein the switching means is configured so that a direction in which the connection switching means performs a switching operation of the delivery connection between the connected state and the evacuated state is along a delivery direction of a paper sheet or sheets between the conveyance path and the stacker;

wherein the delivery connection is pivotally supported by a rotating shaft which is provided on a side of the conveyance path so as to turn as the switching operation, and the rotating shaft always abuts against a positioning part of the counting process unit, which is provided on the side of the conveyance path and by which the connection switching means is positioned relative to the stacker, at least in the connected state.

2. The paper sheet handling apparatus according to claim 1, further comprising a first engagement part provided on a side of the stacker toward the conveyance path and a second engagement part provided on a side of the conveyance path toward the stacker to engage with the first engagement part, wherein the relative positions of the conveyance path and the stacker is determined by engagement between the first engagement part and the second engagement part, and either of the first engagement part and the second engagement part interlocks with the delivery connection.

3. The paper sheet handling apparatus according to claim 1, wherein the delivery connection is structured to permit two-way conveyance of the paper sheet or sheets.

4. The paper sheet handling apparatus according to claim 1, wherein the delivery connection is mounted on a side of the counting processing unit.

5. The paper sheet handling apparatus according to claim 1, further comprising a conveyance path side conveyance connection provided on a side of the conveyance path toward the stacker, and a stacker-side conveyance connection on a side of the stacker toward the conveyance path, and wherein the conveyance path side conveyance connection, the delivery connection, and the stacker-side conveyance connection are structured in comb-shape to nest one another, and a nesting depth in the connected state is at least 9 mm.

6. The paper sheet handling apparatus according to claim 5, wherein the delivery connection is structured to separate from a tip end of the stacker-side conveyance connection in the evacuated state.

7. The paper sheet handling apparatus according to claim 1, further comprising a tray, which stores the stacker, and a drawer mechanism, by which the tray is drawn out from a housing.

8. The paper sheet handling apparatus according to claim 1, wherein the conveyance path and the delivery connection are configured so that a connection space between the conveyance path and a path of the delivery connection for the paper sheet or sheets is maintained when the delivery connection is switched from the connected state to the evacuated state.

9. The paper sheet handling apparatus according to claim 1, wherein the delivery connection is configured to move in an upwards and forward direction from a first position in which the delivery connection is in the connected state, to arrive at a second position corresponding to the evacuated state.

* * * * *